United States Patent [19]

Davies

[11] 4,222,796

[45] Sep. 16, 1980

[54] HIGH STRENGTH DUAL-PHASE STEEL

[75] Inventor: Richard G. Davies, Dearborn, Mich.

[73] Assignee: Ford Motor Company, Dearborn, Mich.

[21] Appl. No.: 9,314

[22] Filed: Feb. 5, 1979

Related U.S. Application Data

[62] Division of Ser. No. 957,375, Nov. 2, 1978.

[51] Int. Cl.[3] ..... C21D 7/14

[52] U.S. Cl. ..... 148/12 F; 148/12.4; 148/144

[58] Field of Search ..... 148/142, 143, 144, 12 F, 148/12.3, 12.4, 36, 134; 75/126 C

[56] References Cited

U.S. PATENT DOCUMENTS

| | | | |
|---|---|---|---|
| 4,033,789 | 7/1977 | Hamburg et al. | 148/134 |
| 4,062,700 | 12/1977 | Hayami et al. | 148/12.3 |
| 4,067,756 | 1/1978 | Koo et al. | 148/36 |
| 4,072,543 | 2/1978 | Coldren et al. | 148/36 |
| 4,159,218 | 6/1979 | Chatfield et al. | 148/12 F |

FOREIGN PATENT DOCUMENTS

| | | | |
|---|---|---|---|
| 604069 | 8/1960 | Canada | 148/36 |
| 1533433 | 9/1970 | Fed. Rep. of Germany | 148/36 |
| 1918922 | 10/1970 | Fed. Rep. of Germany | 148/134 |
| 2130158 | 12/1971 | Fed. Rep. of Germany | 148/134 |

*Primary Examiner*—L. Dewayne Rutledge
*Assistant Examiner*—Peter K. Skiff
*Attorney, Agent, or Firm*—Joseph W. Malleck; Keith L. Zerschling

[57] ABSTRACT

A method of making, and the resulting product, of a dual-phase steel having increased tensile strength and a favorable ductility level is disclosed. The method comprises adding 0.1–0.2 Mo to 0.3–0.5 Cr and/or 0.7–0.2 V, to constitute a combined additive to a manganese-carbon-base steel. Upon heating to the insensitive portion of the intercritical annealing range (740°–830° C.) for 8 minutes and cooling at a rate less than 100° C./sec., a dual-phase steel is produced having about 30% volume fraction martensite and a tensile strength level of about 150 ksi with a 12% elongation value.

5 Claims, 4 Drawing Figures

HIGH STRENGTH DUAL-PHASE STEEL

This is a division of application Ser. No. 957,375, filed Nov. 2, 1978.

BACKGROUND OF THE INVENTION

The terms "dual-phase steel" are used to refer to a steel consisting essentially of a dispersion of martensite in a fine-grained ferrite matrix; these steels are of increasing technological interest because they provide a better combination of strength and ductility than any other steel sheet material. The strength is important because it offers the opportunity to produce lighter components, while good ductility is needed to permit the easy forming of components. It is generally recognized that martensite plays a role in determining the strength level of dual-phase steels. A full understanding of the role played by the phases in determining such characteristics needs to be more fully explored. How to maximize the martensite level of such steels while maintaining good ductility remains the subject of continued research in the industry.

There are currently two methods used to commercially produce dual-phase steels in the United States: (a) inter-critical annealing or (b) austenitic treatment. Intercritical annealing requires the use of an annealing cycle wherein the steel is heated to the alpha+gamma phase region (approximately 730°-840° C. at 0.1 weight percent carbon) and is then cooled at a rate of less than 100° C. per second. The austenite treatment involves controlling the cooling of the steel in the austenitized condition during hot rolling so that the cooling rate is adjusted to promote the existence of both ferrite and martensite in the cooled product.

The chemical composition of the steel used to produce such dual-phase steels by either method typically comprises 0.1% carbon, 1.4% manganese, 0.5% silicon, along with a singular addition of either 0.1% or 0.15% molybdenum or 0.4% chromium.

It has been discovered, with respect to this invention that the strength of dual-phased steels is controlled essentially by the amount of martensite in the structure and that this relationship is linear. It has been further observed as part of this invention that not all of the austenite transforms to martensite upon cooling by either of the methods above described. With intercritical annealing according to the prior art, one finds that additional ferrite and carbides are formed without a complete conversion of all of the austenite to martensite. With respect to the austenitized dual-phase steels, a considerable amount of carbides are formed because the slow cooling path enters the region in which carbides are formed. Therefore, there remains the technological problem of how to achieve an increased martensite content in a dual-phase steel without generation of carbides and to do so at a cooling rate which is less than 100° C. per second, a limitation imposed by the available equipment used in most steel mills today. It is well recognized that if cooling rates highly in excess of 100° C./sec., such as 1000° C./sec., were employed, there would be no difficulty in obtaining increased austenite conversion to martensite; but this alternative is not economically satisfactory.

SUMMARY OF THE INVENTION

The primary object of this invention is to provide an improved dual-phase steel having increased strength at higher ductility levels.

Another object is to provide an improved method of making dual-phase steels which method imparts increased hardenability to the austhenic phase.

Yet another object of this invention is to provide an improved method of making a dual-phase steel which increases the ductility of such steel by increasing the strength level of the ferrite phase.

Detailed features pursuant to the above objects comprise: (a) regulating the chemistry of the steel to contain in addition to the normal ranges of manganese, carbon and silicon, the addition of synergistic elements consisting of 0.07-0.2 vanadium, 0.1-0.2 molybdenum, and 0.3-0.5% chromium, the latter combination of additive elements operating to synergistically suppress the transformation front of the steel in a manner to facilitate use of cooling rates of 100° C. or less and insure substantial transformation of austenite to martensite; (b) controlling the grain size of the resulting dual-phase steel by the employment of a predetermined fine grain starting material having a grain size less than 10 microns; and (c) increasing the strength of the ferrite phase of the limitation of silicon to the range of 0.55-1.0%.

DETAILED DESCRIPTION

Steels having structures consisting of mixtures of ferrite and martensite are often referred to as dual-phase steels, even though there are many commercial steels which have more than one phase. It has been shown that when a commercial SAE grade 980 XK H.S.L.A. steel is heat treated to produce the dual-phase structure, its yield point decreases (for example from 80 to 55 ksi), the total elongation increases from about 18 to 27%, while the tensile strength remains constant at approximately 95 ksi. The increase in ductility and constant tensile strength leads to better formability and makes these dual-phase steels very attractive for use in cold formed high strength components.

Figure 1:
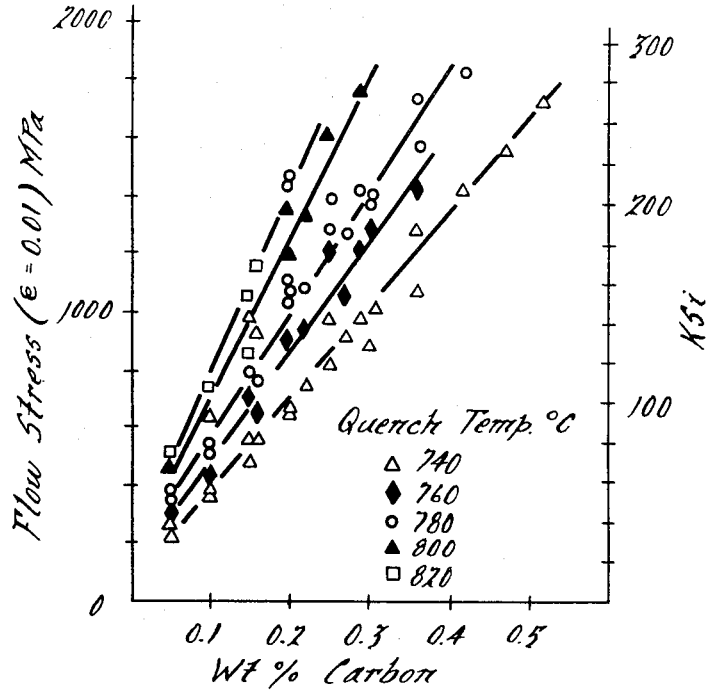
FIG. 1 is a graphical illustration of flow stress as a function of quench temperature and carbon content for a series of vacuum cast dual-phase alloys containing 0.06-0.29 carbon, 1.2-1.5 Mn, and the remainder Fe.

It is surprising to find from a study of dual-phase structures that strength is a linear function of the percent martensite. This is surprising since the martensite content was varied by changing the quenching temperature, and therefore the carbon content of the martensite. The strength of martensite should be presumably very carbon dependent. Turning to FIG. 1, it plots flow stress as a function of quench temperature and carbon content of the alloy for a series of vacuum cast alloys containing 0.06-0.29 carbon, 1.20-1.50 manganese and the remainder iron. It can be seen that, at a given quench temperature, flow stress is linearly dependent upon the carbon content and that, at a given carbon level, the higher the quench temperature the larger the flow stress.

Figure 2:
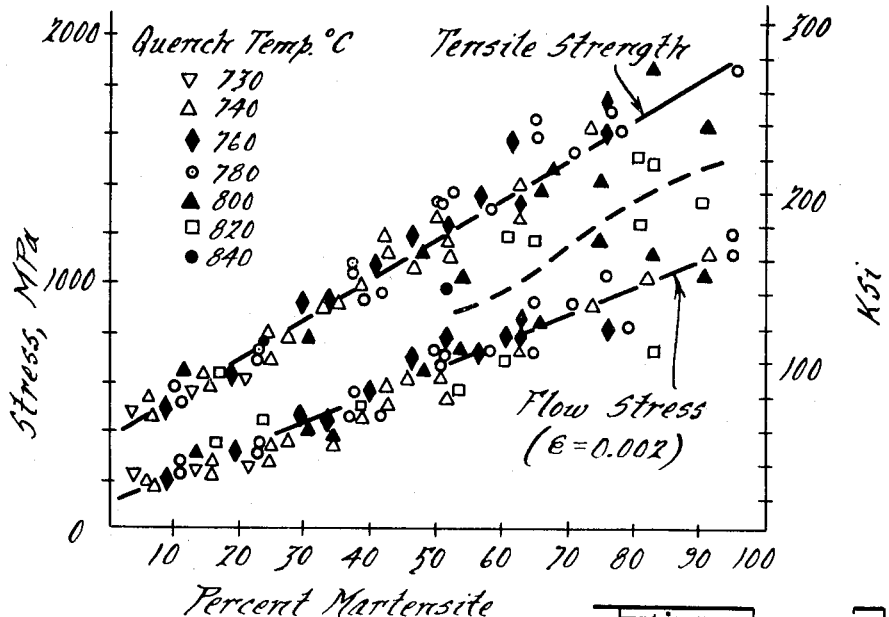
FIG. 2 and 3 are graphical illustrations of flow stress at various strain levels as a function of percent martensite for the alloys of FIG. 1.
Figure 3:
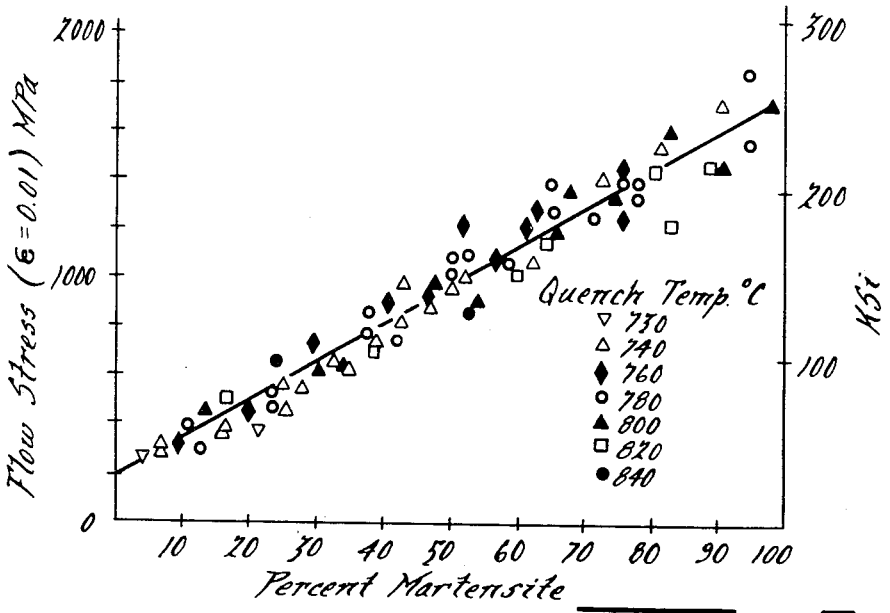

Data with respect to flow stress at various strain levels as a function of percent martensite is presented in FIGS. 2 and 3. It is clear from these figures that all the flow stresses are solely the function of the percent of martensite in the alloy and do not depend upon the carbon content of martensite. This is an unexpected result because from the laws of simple mechanical mixture, it would be predicted that the flow stress of the alloys quenched from 740° C. (carbon content in martensite is approximately 0.57%) should be measurably stronger than alloys quenched from 800° C. (carbon content 0.38). Moreover, martensite strength is known to be very sensitive to such changes in carbon content.

With this relationship in mind, it is a goal of this invention to provide a more complete transformation of all of the austenite to martensite in order to achieve a maximum strength level. However, the state of the art is not capable of insuring that all of the austenite, that is generated by intercritically annealing a steel prepared for dual-phase production, will transform fully to a martensite plus ferrite product. It is known that some alloy additions tend generally to delay the start of transformation to a limited degree and to increase the time for its completion. The importance of this is that in a transformation diagram, plotting temperature versus time, the zone in which certain transformation products occur can be easily depicted. It is desirable that the line or front representing the initiation of transformation products be suppressed and that the line be displaced to the right. In this way, transformation at all temperature levels will start later and is slower to go to completion, thereby upon cooling intercritically annealed steel, it would be more convenient and easier to obtain increased volume fraction of martensite by bypassing such transformation front.

Unfortunately, the state of the art is not capable of completely bypassing this transformation front at cooling rates of 100° C. or slower to achieve greater conversion to martensite; some austenite will transform back to ferrite in dual-phase steels that are produced by the intercritical anneal (this invention is not concerned with steel made by an austenite treatment since such steels inherently contain carbides detrimental to the ultimate strength of the steel.

Figure 4:
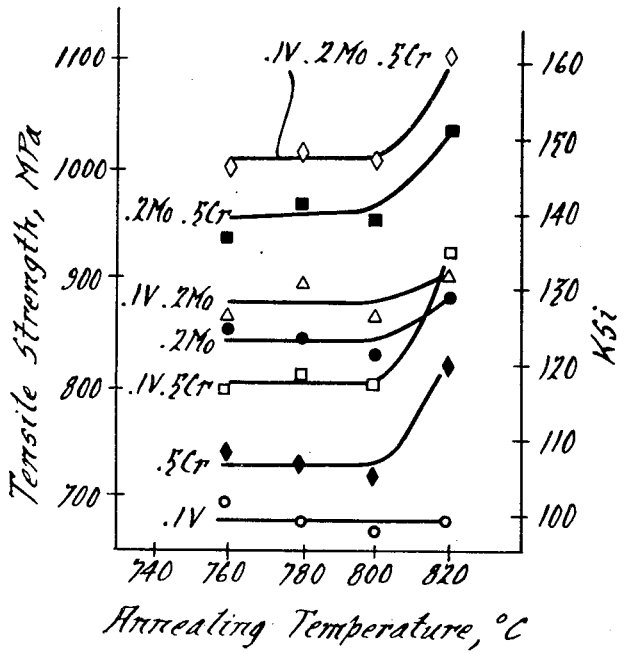
FIG. 4 is a graphical illustration of tensile strength as a function of annealing temperature for the alloys of FIGS. 1-3 to which has been added various strengthening alloys.

As an example of the state of the art, it is readily known that small additions of vanadium or chromium will facilitate an increase in the strength of a dual-phase steel. The effect of the alloying element employed differs greatly both in magnitude and effect in different temperature regions so that the precise strength prediction of a given alloy combination is not quite possible. The prior art has employed small quantities of vanadium or chromium in the production of dual-phased steels. The net result of this is displayed in FIG. 4, wherein employing a variety of intercritical annealing temperatures from 760°–820° C., the tensile strength for a 0.1% vanadium steel remains just below 100 ski. With 5% chromium, the strength level remains substantially at 105 ski when employing annealing temperature between 760°–800° C., but at 820° C. the strength level is slightly elevated to 120 ksi.

It is the discovery of this invention that by employing 0.1–0.20% molybdenum, particularly in combination with 0.07–0.2% vanadium and 0.3–0.5% chromium, a dramatic synergistic effect takes place which insures that considerably more of the austenite which is generated upon heating to the intercritical range will be converted to martensite upon cooling at rates of 100° C. or less. These particular chemical ingredients remove interstitial atoms from the ferrite matrix during the production of these dual-phase steels. Only by providing a completely interstitially free matrix can there occur the optimum combination of strength and ductility which is achieved by the highest conversion of austenite to martensite. To prove this effect, a series of alloy ingots were prepared by vacuum melting with a base composition consisting of (by weight percent) 0.11 carbon, 1.4 manganese and 0.55 silicon. To this was added singly and in all combinations of 0.1 vanadium, 0.2 molybdenum/or 0.5 chromium. The ingots were hot rolled to sheet form having a thickness of approximately 0.1 inch. Tensile specimens were prepared directly from this hot rolled material by cutting sections 2×0.5 inches. A ferrite grain size of about 10 microns was obtained by annealing the hot rolled product separately, but this is normally provided by control of the grain size during hot rolling. The dual-phase structure was produced by annealing at temperatures between 760° and 820° C., (the insensitive portion of the intercritical annealing range) for 8 minutes, the increments of temperature levels for the different specimens being demonstrated in FIG. 4. Cooling from the intercritical annealing temperature was carried out to room temperature in forced air at a rate of about 30° C. per second. The tensile specimens resulting from such heat treatment were tested in an Instron machine at room temperature at a cross head rate of approximately 2×10–2 mm/s (0.05 in./min.)

The synergism effect is most evident when the specimen, containing only 0.1% V as the additive to the base manganese-carbon-iron alloy, is considered. It possessed a tensile strength of about 100 KSI from data illustrated in FIG. 4. When chromium is employed as the only additive to the base manganese-carbon-iron alloy, a tensile strength of about 105 ksi is obtained, a difference of 5 ksi over the vanadium steel. When both vanadium and chromium are combined as the additives, a tensile strength of about 120 ksi is obtained an increment of 15 ksi over the steel with only chromium. When vanadium, chromium, and molybdenum are combined as the additive, a tensile strength of about 150 ksi is obtained at annealing temperatures of 760°–800° C., an increment of 30 ksi over the chromium-vanadium additive steel. Similarly the combining of molybdenum with either chromium (rendering a tensile strength of about 140 ksi) or vanadium (rendering a tensile strength of about 130 ksi) is a significant increment over the use of chromium by itself (about 105 ksi) or vanadium by itself (about 100 ksi).

Grain size plays an important role with respect to achieving the best combination of strength and ductility. To this end, the use of a known grain refining element (niobium) was investigated. The grain refinement observed in the dual-phase structure was in general a reflection of the grain refinement that took place in the austenite during hot rolling of the steel ingot. Micrographs of these alloys after quenching from 760° C., confirm that niobium additions resulted in a finer grain size and the higher manganese level, particularly in the presence of niobium, produced the best grain refinement. The strength of test alloys as a function of quench temperature can be understood in terms of varying martensite content and grain size. Alloys having comparable grain sizes and martensite contents will have their strengths about the same, while alloys having similar martensite contents but with different grain sizes will have different strength levels. It is concluded that to maximize the ductility in combination with the strength of dual-phase steel, the ferrite phase should possess a fine grain size to make the ferrite of greater strength and be free of fine precipitates and intersititial alloying elements. Grain refinement is principally a matter of proper rolling techniques, including a proper sequence of incremental thickness reductions at correspondingly lower temperature levels for each successive reduction, such as exemplified in Making, Shaping and Treating of Steel, published by U.S. Steel Corp., chapter 44. With such rolling techniques, the appropriate grain size of less than 10 microns can be assured.

In addition, solid solution strengthening can be achieved by use of silicon as a substitutional strengthener or iron. It has been found that silicon increases the uniform elongation of ferrite at a constant yield stress this particularly at 0.55–1%, but the effect can be obtained with as little as 0.25% silicon. This effect is especially pronounced at low temperatures.

By utilizing both the synergistic effect from a combined vanadium-chromium-molybdenum addition, and prior grain refinement (3–7 microns), a unique dual-phase composition at the thickness of 0.25 inches or less results which is characterized by about 30% volume fraction of martensite uniformly dispersed throughout a fine grained ferrite matrix devoid of carbon.

The composition exhibits an elongation of at least 14% at a tensile strength level of 140 ksi and 12% at 150 ksi. The total alloying ingredients selected from V, Mo and Cr, should be no greater than 0.8%, the individual ranges for said elements being 0.07–0.2 vanadium, 0.3–0.5 chromium, and 0.1–0.2 molybdenum.

Ther ferrite matrix is substantially interstitially free, devoid of carbides, and characterized by a strength level of 55 ksi at a grain size of 5–10 microns. Relatively speaking, the ferrite matrix is soft (having a Brinnell will have their strengths about the same, while alloys having similar martensite contents but with different grain sizes will have different strength levels. It is concluded that to maximize the ductility in combination with the strength of dual-phase steel, the ferrite phase should possess a fine grain size to make the ferrite of greater strength and be free of fine precipitates and interstitial alloying elements. Grain refinement is principally a matter of proper rolling techniques, including a proper sequence of incremental thickness reductions at correspondingly lower temperature levels for each successive reduction, such as exemplified in making, shaping and treating of steel, published by U.S. Steel Corp., chapter 44. With such rolling techniques, the appropriate grain size of less than 10 microns can be assured.

In addition, solid solution strengthening can be achieved by use of silicon as a substitutional strengthener of iron. It has been found that between 0.55–1.0% silicon increases the uniform elongation of ferrite at a constant yield stress; this effect is especially pronounced at low temperatures.

By utilizing both the synergistic effect from a combined vanadium-chromium-molybdenum addition, and prior grain refinement (3–7 microns), a unique dual-phase composition at the thickness of 0.15 inches or less results which is characterized by about 30% volume fraction of martensite uniformly dispersed throughout a fine grained ferrite matrix devoid of carbon.

The composition exhibits an elongation of at least 14% at a tensile strength level of 140 ksi and 12% at 150 ksi. The total alloying ingredients selected from V, Mo and Cr, should be no greater than 0.8%, the individual ranges for said elements being 0–0.15 vanadium, 0.3–0.5 chromium, and 0.1–0.2 molybdenum.

The ferrite matrix is substantially interstitially free, devoid of carbides, and characterized by a strength level of 55 ksi at a grain size of 5–10 microns. Relatively speaking, the ferrite matrix is soft (having a Brinnell value of 100), compared to the martensite phase (having a Brinnell hardness level in excess of 400).

I claim:

1. A method of making a dual-phase steel comprising:

(a) hot-forming a flat rolled steel product consisting essentially of, by weight, 0.05–0.15% carbon, 0.25–1.0% silicon, 1.2–1.6% manganese, 0.07–0.2% vanadium, 0.1–0.2% molybdenum and 0.3–0.5% chromium, (b) heat said product to the insensitive portion of the intercritical annealing temperature range generally equivalent to 740°–830° C., permitting the carbon of said steel to be segregated in solution so as to be constituted of dual-phases comprises of austenite and ferrite, said austenite constituting 30–40% by volume of said heated product, (c) cooling said heat product at a rate of less than 100° C. per second to room temperature to convert substantially all of the austenite to martensite.

2. The method as in claim 1, in which the flat rolled steel is controlled to a thickness of ¼ inch or less to avoid a transformation product gradient.

3. The method as in claim 1, in which the hot forming step is carried out in a series of reduction stages at progressively lower temperatures to produce a grain size of 3–7 microns.

4. The method as in claim 1 in which silicon is further limited to 0.55–1.0% to increase the strength of the ferrite phase.

5. The product resulting from the practice of the process in claim 4, the product having a strength level of at least 140 ksi and an elongation of at least 12%.

* * * * *